US005600993A

United States Patent [19]

Heaman

[11] Patent Number: 5,600,993

[45] Date of Patent: Feb. 11, 1997

[54] FLEXIBLE SHOE FOR A BENDING MACHINE

[76] Inventor: Norman L. Heaman, 11 Meadow Crescent, Edmonton, Alberta, Canada, T6C 1G1

[21] Appl. No.: 550,077

[22] Filed: Oct. 30, 1995

[51] Int. Cl.[6] ..... B21D 3/10

[52] U.S. Cl. ..... 72/382; 72/389.1; 72/389.8; 72/389.6

[58] Field of Search ..... 72/382, 389.1, 72/389.8, 413, 388, 369, 390.6, 389.6

[56] References Cited

U.S. PATENT DOCUMENTS

| | | | |
|---|---|---|---|
| 2,755,761 | 7/1956 | Carr | 72/390.6 |
| 3,335,588 | 8/1967 | Cummings | 72/382 |
| 3,568,493 | 3/1971 | Wirt et al. | 72/389 |
| 3,834,210 | 9/1974 | Clavin et al. | 72/369 |
| 4,782,686 | 11/1988 | Carson, Jr. | 72/389 |
| 5,123,272 | 6/1992 | Heaman | 72/389 |
| 5,353,622 | 10/1994 | Theener | 72/389.8 |

FOREIGN PATENT DOCUMENTS

| | | | |
|---|---|---|---|
| 0271689 | 3/1966 | Australia | 72/389 |
| 0562718 | 6/1960 | Belgium | 72/389 |
| 0159905 | 4/1905 | Germany | 72/413 |
| 0588582 | 2/1959 | Italy | 72/389 |
| 0136232 | 10/1981 | Japan | 72/390 |
| 81925 | 5/1982 | Japan | 72/369 |
| 0184021 | 10/1983 | Japan | 72/389 |
| 0002482 | 1/1902 | United Kingdom | 72/389 |

*Primary Examiner*—David Jones
*Attorney, Agent, or Firm*—Anthony E. Lambert

[57] ABSTRACT

A flexible shoe for a bending machine which includes a pair of flexible resilient spring-like shafts. A flexible web extends between and is secured to the pair of shafts.

6 Claims, 3 Drawing Sheets

FLEXIBLE SHOE FOR A BENDING MACHINE

FIELD OF THE INVENTION

The present invention relates to a flexible shoe for a bending machine and, in particular, pipe bending machines used to bend large diameter pipe for oil and gas pipelines.

BACKGROUND OF THE INVENTION

Pipe bending machines used to bend large diameter pipe for oil and gas pipelines have at least one flexible shoe that engages the pipe and accommodates the bending moment. With an end-pull style pipe bending machines, a single flexible shoe is positioned on top of the pipe. A sling is then used to pull one end of the pipe, thereby forcing the pipe upwardly against the flexible shoe. With center-push style pipe bending machines three flexible shoes are used; two lower shoes and one upper shoes. The two lower shoes support the pipe in spaced relation. The upper shoe exerts a downward force between the two lower shoes to bend the pipe.

The flexible shoes presently consist of a plurality of closely spaced parallel arcuate segments. The segments are generally made of metal and coated with rubber or urethane, so as not to damage the pipe. An inherent problem with such flexible shoes is that they require frequent and costly repairs, as tears in the rubber or urethane coating commonly occur and recoating is required.

SUMMARY OF THE INVENTION

What is required is a flexible shoe that requires less maintenance and is less expensive to repair.

According to the present invention there is provided a flexible shoe for a bending machine which includes a pair of flexible resilient spring-like shafts. A flexible web extends between the pair of shafts. Means is provided for securing the flexible web to the shafts.

The flexible shoe, as described above, is easy to maintain and inexpensive to maintain in comparison with the flexible shoes that consist of a plurality of arcuate coated segments. If wear occurs in the flexible web, a replacement for the flexible web can be substituted in a matter of minutes. The preferred manner of attaching a flexible shoe for a pipe bending machine which includes a pair of sleeves secured to the flexible web in parallel spaced relation. One of the flexible resilient spring-like shafts is disposed in each of the sleeves. There are a variety of ways in which the flexible shoe, as described above, can be secured to a flexible shoe mounting of a pipe bending machine. It is preferred that each of the sleeves have radial slots. Remote ends of the arms of the flexible shoe mounting of the pipe bending machine can be inserted through the radial slots and then the shafts extended through apertures in the remote ends of the arms to secure flexible shoe to the arms. This manner of mounting is viewed as being the simplest and most cost effective.

Although beneficial effects may be obtained through the use of the flexible web, as described above, another problem present in the prior art is that the pressure exerted by flexible shoes made from segments is mostly on the top of the pipe. This uneven pressure results in some "egging" of the pipe occurring. Even more beneficial effects may, therefore be obtained when a plurality of rollers are mounted on each shaft. The rollers secured as they are to the ends of the flexible web, wrap around the pipe and apply side pressure.

This provides more even pressure and prevents "egging" of the pipe from occurring. The rollers also provide a number of secondary functions. Depending upon the types of mounting used, they assist with the positioning of the pipe. They also increase the surface area over which the force is spread. This decreases the pressure exerted per square inch upon the flexible web.

Although beneficial results may be obtained through the use of the flexible shoe, as described above, even more beneficial effects can be obtained when the flexible shoe is used in combination with a pipe bending machine that has a mounting suited to emphasize its advantages. According to another aspect of the present invention there is the flexible shoe used in combination with a pipe bending machine having a mounting for a flexible shoe that includes a support and a first pair of spaced apart mounting arms. At least one of the arms is pivotally mounted to the support for movement toward and away from the other of the arms. Each of the arms has a remote end with an aperture. A second pair of spaced apart arms is also provided. At least one of the arms is pivotally mounted to the support for movement toward and away from the other of the arms. Each of the arms has a remote end with an aperture. The apertures in the second pair of arms are in placed in axial alignment with the apertures in the first pair of arms. The mounting arms of the pipe bending machine extend through slots in the flexible web. The shafts extend through the apertures at the remote ends of the arms to couple the sleeves to the arms with the flexible web suspended between. This form of mounting with one movable arm helps cooperate with the rollers and the flexible web to provide an even pressure upon the pipe.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
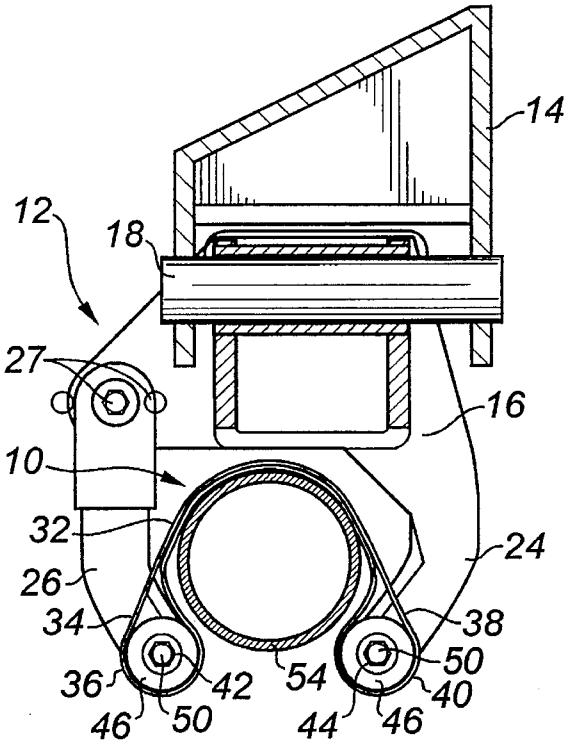
FIG. 2 is an end elevation view of the flexible shoe illustrated in FIG. 1.

The preferred embodiment, a flexible shoe for a pipe bending machine generally identified by reference numeral 10, will now be described with reference to FIGS. 1 through 4.

Figure 1:
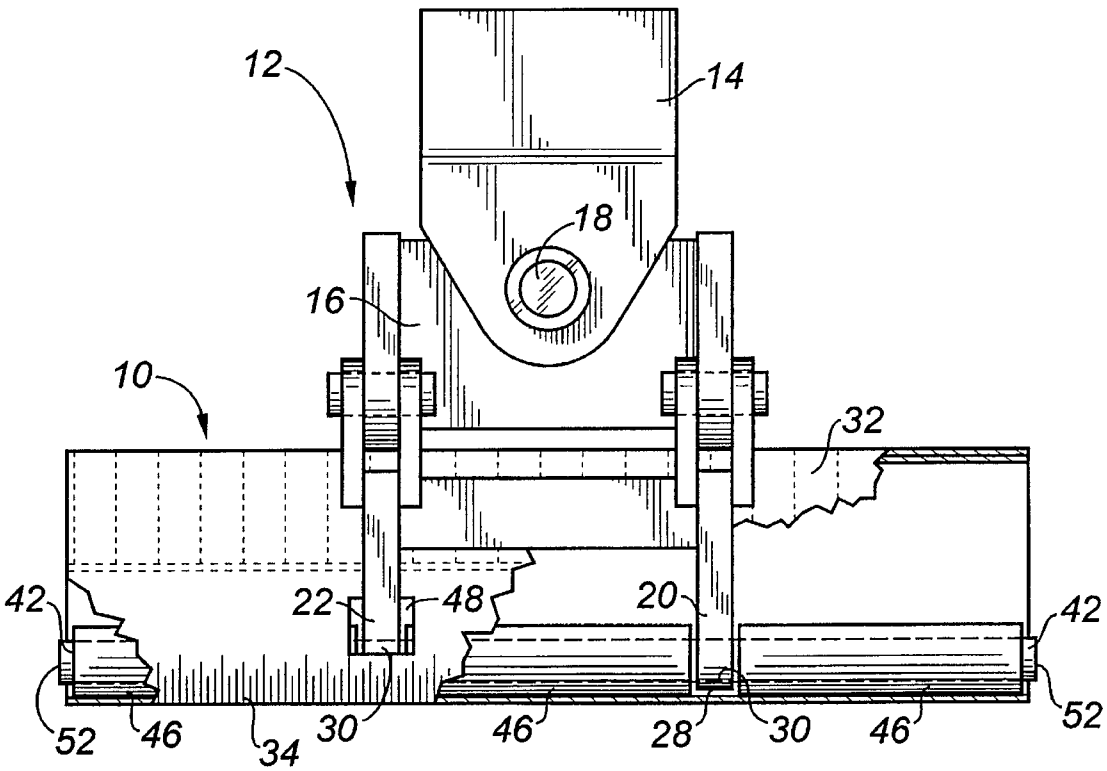
FIG. 1 is a side elevation view, partially of section of a flexible shoe constructed in accordance with the teachings of the present invention mounted on a flexible shoe mounting of a pipe bending machine.

Referring to FIGS. 1 and 2, flexible shoe 10 is illustrated mounted on a unique flexible shoe mounting 12. Shoe mounting 12 is supported by a mounting adaptor 14 of conventional construction from a pipe bending machine. Flexible shoe mounting 12 is especially adapted to get the best results out of the present invention, as will hereinafter be further described. Flexible shoe mounting 12 consists of a support 16 which is pivotally mounted by means of a pin 18 to mounting adaptor 14. Referring to FIG. 1, a first pair of spaced apart mounting arms 20 and a second pair of mounting arms 22 are provided. Referring to FIG. 2, mounting arms 20 are illustrated. It will be understood that although second pair of mounting arms 22 are not shown they are identical in construction to first pair of mounting arms 20. First pair of mounting arms 20 include a stationary arm 24 and a movable arm 26 which is pivotally mounted to support 16 for movement toward and away from stationary arm 24. There are a number of alternative mounting apertures 27, provided providing a number of alternative mounting positions for movable arm 26. Each of first pair of arms 20 and second pair of arms 22 have a remote end 28 with an aperture 30 extending therethrough. Apertures 30 in second pair of arms 22 are in axial alignment with apertures 30 in first pair of arms 20.

Referring to FIGS. 1 and 2, flexible shoe 10 includes an elongate flexible fabric web 32 having a first longitudinal sleeve 34 positioned along a first side 36 and a second longitudinal sleeve 38 positioned along a second side 40. A first flexible resilient spring-like shaft 42 is positioned in first longitudinal sleeve 34. A second flexible resilient spring-like shaft 44 is positioned in second longitudinal sleeve 38. Three flexible tubular rollers 46 extend over each of first shaft 42 and second shaft 44. Rollers 46 engage first longitudinal sleeve 34 and second longitudinal sleeve 38. Each of first longitudinal sleeve 34 and second longitudinal sleeve 38 have a pair of spaced apart slots 48 through which first pair of mounting arms 20 and second pair of mounting arms 22 of shoe mounting 12 extend. First shafts 42 and second shaft 44 extend through apertures 30 at remote ends 28 of first pair of arms 20 and second pair of arms 22 to couple first longitudinal sleeve 34 and second longitudinal sleeve 38 to first pair of arms 20 and second pair of arms 22 with flexible web 32 suspended between stationary arm 24 and movable arm 26. Locking Fasteners 50 are placed on remote ends 52 of first shaft 42 and second shaft 44 to prevent their removal. In the description which follows a pipe will be generally identified by reference numeral 54.

Figure 3:
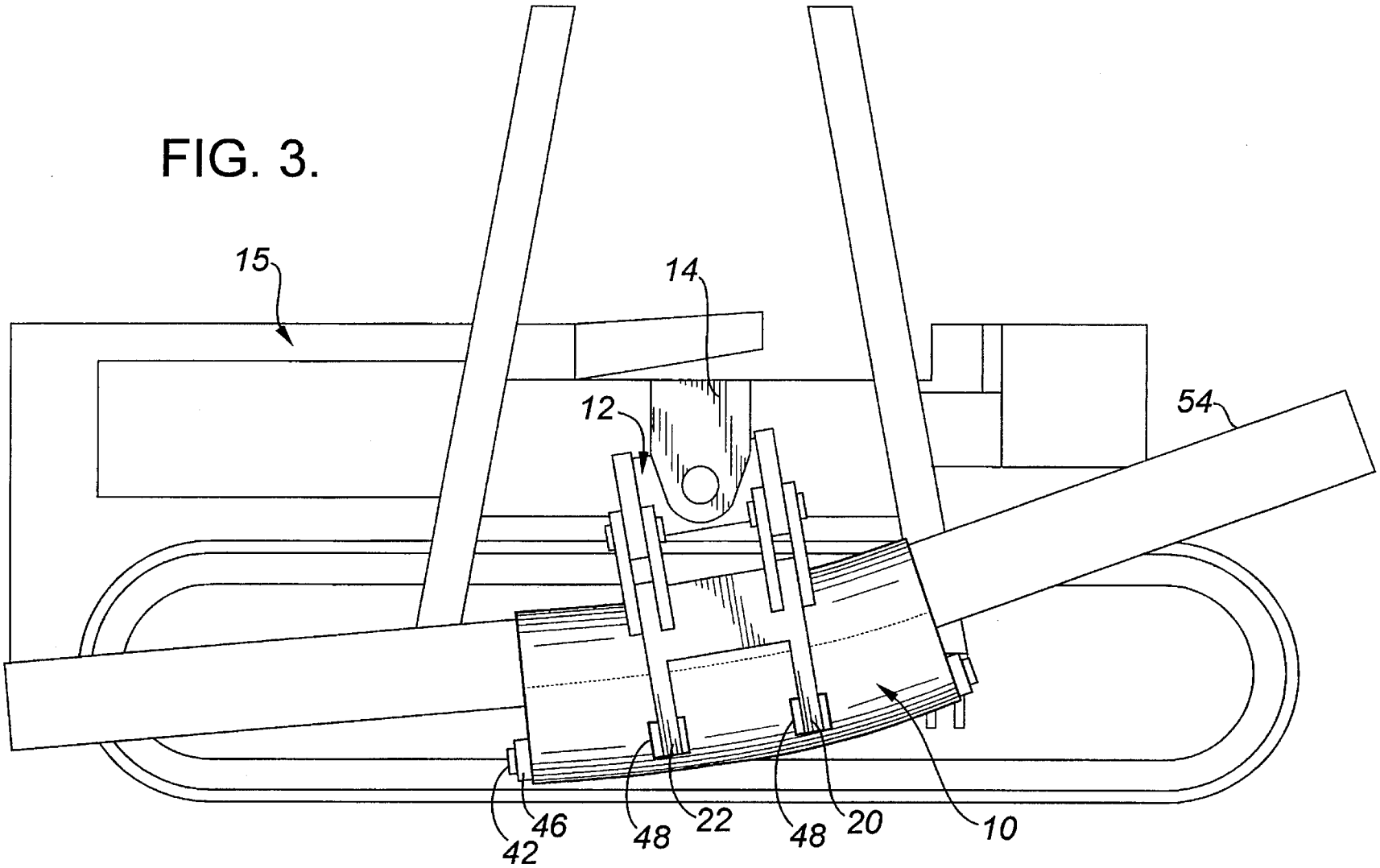
FIG. 3 is a side elevation view of the flexible shoe illustrated in FIG. 1, mounted on a end-pull style of pipe bending machine.
Figure 4:
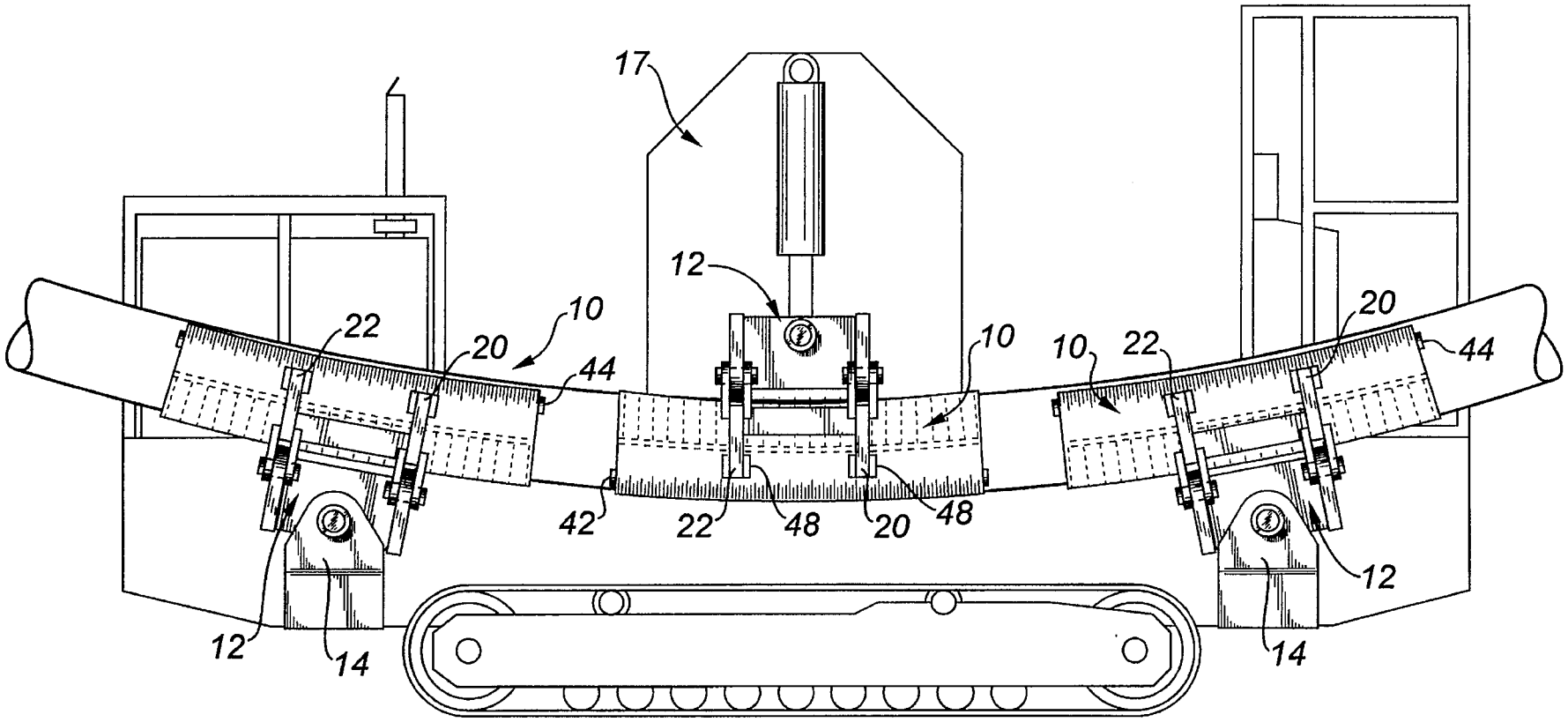
FIG. 4 is a side elevation view of the flexible shoe illustrated in FIG. 1, mounted on a centre push style of pipe bending machine.

The use and operation of flexible sleeve 10 will now be described with reference to FIGS. 1 through 4. The component parts of flexible shoe 10 must be assembled in situ onto shoe mounting 12. This is accomplished by positioning one of rollers 46 within first longitudinal sleeve 34 and extending stationary arm 24 of first pair of arms 20 and stationary arm 24 of second pair of arms 22 through slots 48. First shaft 42 is then extended through apertures 30 at remote ends 28 of stationary arms 24 and through roller 46. The other rollers 46 are then placed on either end of first shaft 42. Locking fasteners 50 are then placed on remote ends of first shaft 42 to prevent rollers 46 from being removed. Of course, this also prevents first shaft 42 from being withdrawn from apertures 30. The process is repeated on the other side, with one of rollers 46 positioned within second longitudinal sleeve 38 and movable arm 26 of first pair of arms 20 and movable arm 26 of second pair of arms 22 being extended through slots 48. Second shaft 44 is then extended through apertures 30 at remote ends 28 of movable arms 26 and through roller 46. The other rollers 46 are then placed on either end of second shaft 44. Locking fasteners 50 are then placed on remote ends of second shaft 44 to prevent rollers 46 from being removed. FIG. 3 illustrates flexible shoe 10 in use on an end-pull style of pipe bending machine 15. FIG. 4 illustrates flexible shoe 10 in use on a center-push style of pipe bending machine 17. Referring to FIG. 2, it is to be noted how flexible shoe 10 wraps around pipe 54 with rollers 46 engaging and applying side pressure to pipe 54. This enables more even pressure to be applied to prevent pipe 54 from "egging". Rollers 46 also help position pipe 54 relative to arms 24 and 26. Referring to FIGS. 3 and 4, it is to be noted the manner in which first shaft 42, second shaft 44 and rollers 46, flex to accommodate the bending of pipe 54. First shaft 42, second shaft 44 and rollers 46 are both flexible and resilient. They spring back to their original configuration when the bending of pipe 54 is completed and pipe 54 is withdrawn from flexible shoe 10. Rollers 46 are flexible in order to accommodate the movement of spring-like shafts 42 and 44. Rollers 46 must also be able to withstand the compression force placed upon them during the bending operation. Shoe mounting 12 assists the operation of flexible shoe 10. Movable arm 26 works in conjunction with rollers 46 to enable rollers 46 to apply greater side pressure than would be possible with a fixed mounting. Pivot pin 18 allows shoe mounting 12 to pivot during the bending process. The selection of one of mounting apertures 27 for movable arm 26 is made depending upon the size of pipe being bent and the amount of side pressure required.

It will be apparent to one skilled in the art the manner in which flexible shoe 10 overcomes the disadvantages inherent in the prior art. Flexible shoe 10 is easy, quick and inexpensive to maintain. Maintenance on flexible shoe 10 is primarily limited to replacement of flexible web 32 when it becomes worn. Rollers 46 provide side pressure on pipe 54 as it is being bent to provide a better quality of bend. A conventional segmented flexible shoe is approximately 28 inches in length. Flexible web 32 can be made longer (44 inches or more), which also seems to improve the quality of the bend.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A flexible shoe for a bending machine, comprising:

a pair of flexible resilient spring-like shafts;

a flexible web extending between the pair of shafts; and means for securing the flexible web to the shafts.

2. A flexible shoe for a bending machine, comprising:

a pair of flexible resilient shafts;

a flexible web extending between the pair of shafts; and means for securing the flexible web to the shafts, the means for securing the flexible web to the shafts being parallel spaced sleeves secured to the flexible web, the shafts being received in the sleeves.

3. The flexible shoe as defined in claim 2, wherein a plurality of flexible rollers are mounted on each shaft.

4. The flexible shoe as defined in claim 2, wherein each of the sleeves has radial slots.

5. A flexible shoe for a bending machine, comprising:

an elongate flexible fabric web having a first longitudinal sleeve positioned along a first side and a second longitudinal sleeve positioned along a second side;

a first flexible resilient spring-like shaft positioned in the first longitudinal sleeve;

a second flexible resilient spring-like shaft positioned in the second longitudinal sleeve; and a plurality of flexible tubular rollers extending over each of the first shaft and the second shaft, the rollers engaging the first longitudinal sleeve and the second longitudinal sleeve.

6. In combination;

a. a bending machine having a mounting for a flexible shoe comprising:

a support;

a first pair of spaced apart mounting arms, at least one of the arms being pivotally mounted to the support for movement toward and away from the other of the arms, each of the arms having a remote end with an aperture;

a second pair of spaced apart arms, at least one of the arms being pivotally mounted to the support for movement toward and away from the other of the arms, each of the arms having a remote end with an aperture, the apertures in the second pair of arms being in axial alignment with the apertures in the first pair of arms;

b. a flexible shoe for a bending machine, comprising:

a pair of sleeves in parallel spaced relation;

a flexible web extending between the pair of sleeves;

a flexible resilient spring-like shaft disposed in each of the pair of sleeves; and each of the sleeves having slots through which the mounting arms of the pipe bending machine extend, the shafts extending through the apertures at the remote ends of the arms to couple the sleeves to the arms with the flexible web suspended between.

* * * * *